US006513668B1

(12) United States Patent
Masterton

(10) Patent No.: US 6,513,668 B1
(45) Date of Patent: Feb. 4, 2003

(54) METHOD AND APPARATUS FOR AN INVERTABLE CONTAINER CAP FUNNEL

(76) Inventor: Patrick Masterton, 1150 Brighton, Carol Stream, IL (US) 60188

( * ) Notice: Subject to any disclaimer, the term of this patent is extended or adjusted under 35 U.S.C. 154(b) by 159 days.

(21) Appl. No.: 09/693,391

(22) Filed: Oct. 20, 2000

Related U.S. Application Data

(60) Provisional application No. 60/160,467, filed on Oct. 21, 1999.

(51) Int. Cl.[7] ..... B65D 39/00

(52) U.S. Cl. ..... 215/257; 215/253; 215/303; 220/277; 222/541.2

(58) Field of Search ..... 215/257, 253, 215/252, 250, 48, 49, 303, 321; 220/277; 222/541.2, 80; 206/222

(56) References Cited

U.S. PATENT DOCUMENTS

| | | | | |
|---|---|---|---|---|
| 3,586,196 A | * | 6/1971 | Barton | 215/250 X |
| 3,840,136 A | * | 10/1974 | Lanfranconi et al. | 206/222 |
| 4,307,821 A | | 12/1981 | McIntosh | |
| 4,338,983 A | | 7/1982 | Hatcher | |
| 4,482,070 A | * | 11/1984 | Dubach | 215/253 |
| 4,600,042 A | | 7/1986 | York et al. | |
| 4,615,437 A | * | 10/1986 | Finke et al. | 206/222 |
| 4,703,867 A | | 11/1987 | Schoenhard | |
| 4,976,379 A | | 12/1990 | Sloan | |
| 5,101,870 A | | 4/1992 | Farris | |
| 5,188,157 A | | 2/1993 | Lee | |
| 5,316,059 A | | 5/1994 | Lahnan et al. | |
| D363,221 S | | 10/1995 | Puryear | |
| 5,667,085 A | * | 9/1997 | Ogden et al. | 215/220 |
| 5,960,972 A | * | 10/1999 | Larguia, Sr. | 215/253 |

FOREIGN PATENT DOCUMENTS

| | | | | |
|---|---|---|---|---|
| DE | 2606407 A1 | * | 9/1977 | 215/257 |

* cited by examiner

*Primary Examiner*—Jes F. Pascua
(74) *Attorney, Agent, or Firm*—Sonnenschein Nath & Rosenthal

(57) ABSTRACT

A container and closure assembly, which includes a container and a container cap. The container cap is attached to the neck of the container through the use of an annual securing ring, which is incorporated into the cap and approximates the securing ring in the neck of the bottle and is press fit over the neck of the bottle. The opening of the container is covered with a section of cap that extends some distance into the neck of the container. The container is sealed at the surfaces where the inside of the container neck, the lip of the container neck and the outside of the container neck come in contact with the container cap. The contents of the bottle can be dispensed from the inverted position by rotating the container cap circumferentially with respect to the neck of the container. The circumferential motion causes the offset tool in the neck of the bottle to engaged the engagement ring in the base of the container cap thereby causing the container cap diaphragm to shear away from the container cap main body along the annular strain relief between the container cap diaphragm and the main body of the container cap.

23 Claims, 5 Drawing Sheets

METHOD AND APPARATUS FOR AN INVERTABLE CONTAINER CAP FUNNEL

CROSS REFERENCE TO RELATED APPLICATION

This application claims the benefit of U.S. Provisional Application No. 60/160,467, entitled "METHOD AND APPARATUS FOR AN INVERTABLE CONTAINER CAP FUNNEL," filed Oct. 21, 1999, that is incorporated by reference.

BACKGROUND OF THE INVENTION

1. Technical Field

The present invention relates generally to container closure assemblies and, in particular, to container cap funnels.

2. Related Art

Containers with closure assemblies such as an oil bottle must be opened in the up right position. The bottle must be carefully inverted in order to pour the liquid or fine-grained material out of the container. A problem of spillage occurs when attempting to pour the container contents into a small orifice. Often a separate funnel is used to avoid the spillage. What is needed in the art is a cap closure assembly that is invertible before opening.

SUMMARY

A container cap apparatus having a body with a cap diaphragm and a cap neck containing an engagement ring associated with an offset puncture tool. The engagement ring is in contact with the offset puncture tool that penetrates the cap diaphragm in response to a circumferential force applied to the engagement ring for opening the container cap apparatus. The cap diaphragm prevents the flow of liquid or other material while the container is inverted. Penetration of the cap diaphragm by the offset puncture tool while the container having the container cap inverted allows the flow of liquid or material.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon clearly illustrating the principles of the invention. Moreover, in the figures, like reference numerals designate corresponding parts throughout the different views.

DETAILED DESCRIPTION

Figure 1:
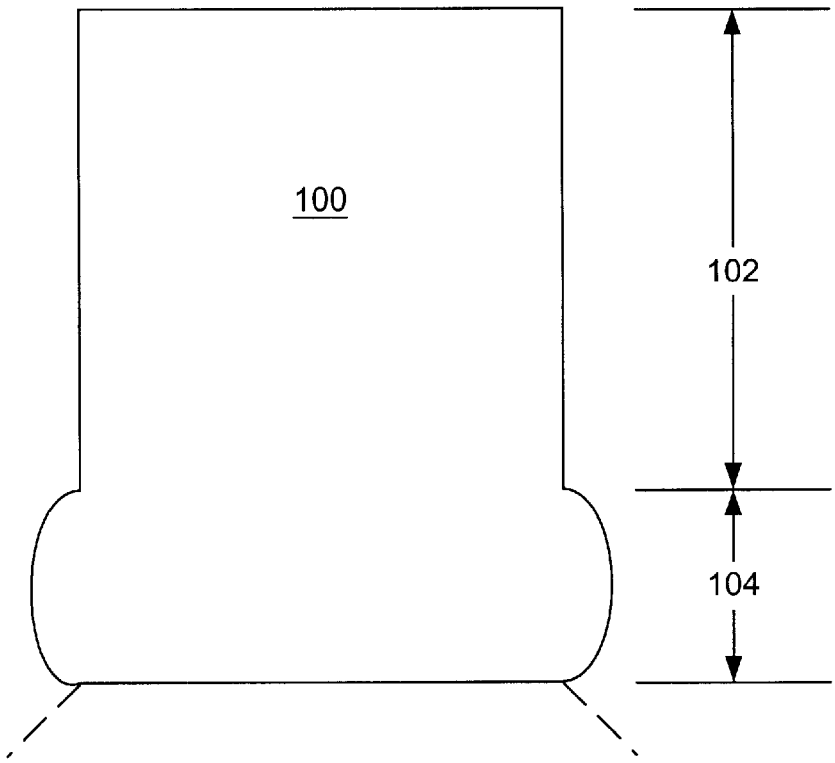
FIG. 1 is a side view of a container cap in accordance with an embodiment of the invention.

In FIG. 1, a side view of a container cap 100 in accordance with an embodiment of the invention is shown. The container cap can be selectively fabricated out of a moldable substance such as a plastic, polymers, or any other substance that is compliant and shearable. The preferred fabrication material is plastic. The container cap has a main body 102 (a cap neck) and an annular securing ring 104 that holds the container cap on a container (shown as dashed lines).

Figure 2:
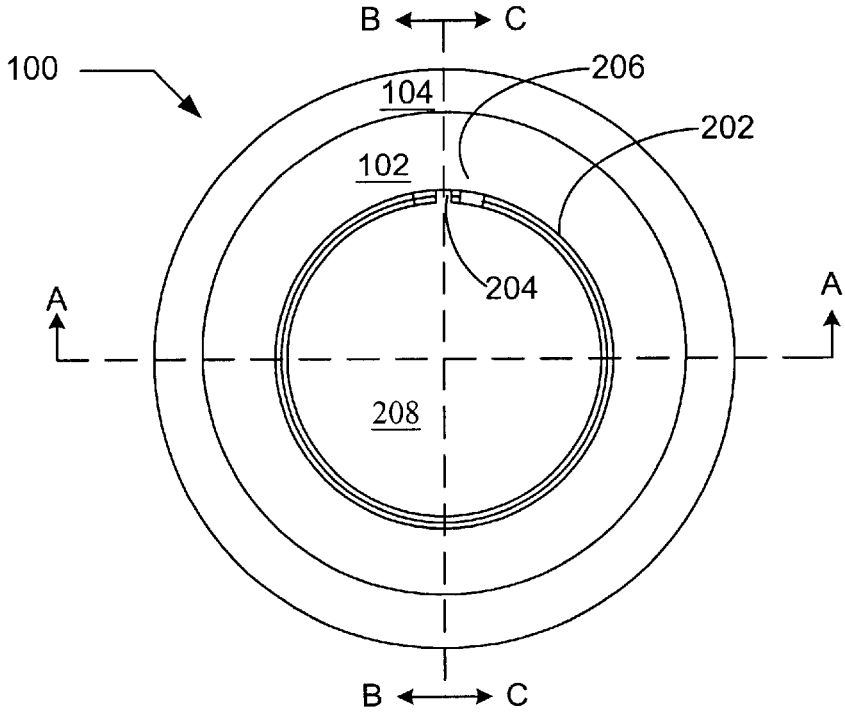
FIG. 2 is a bottom view of the container cap of FIG. 1.

Turning to FIG. 2, a bottom view of the container cap 100 of FIG. 1 is shown. The container cap 100 has the main body 102 with the annular securing ring 104. An engagement ring 202 is secured or formed within the inner surface of the main body 102. The engagement ring 202 forms a discontinuity space 204 and has a rotational stop 206 formed or secured on the engagement ring adjacent to the discontinuity space 204. The engagement ring 202 is below a cap diaphragm 208 that seals the container. In an alternative embodiment, the engagement ring 202 and the cap diaphragm 208 may be located in the annular securing ring 104. The purpose of the cap diaphragm 208 is to provide a seal to prevent, while the cap diaphragm 208 is in tack, the contents of a container from flowing when inverted.

Figure 3:
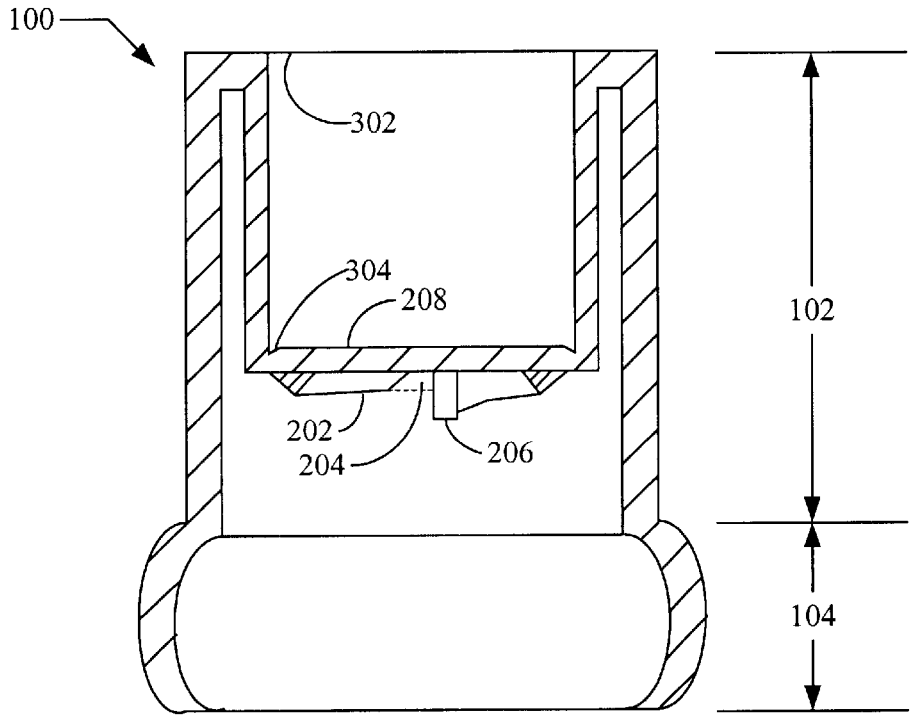
FIG. 3 is a cross sectional view of the container cap of FIG. 1 along "A" in FIG. 2.

In FIG. 3, a cross sectional view of the container cap of FIG. 1 along "A" in FIG. 2 is shown. The container cap 100 has the main body 102 with the annular securing ring 104. The engagement ring 202 is secured or formed within the inner surface of the main body 102 and below a cap diaphragm 208 that seals the container at the main body 102 of the container cap 100. The engagement ring 202 forms a discontinuity space 204 and has a rotational stop 206.

In the present embodiment, the cap diaphragm 208 is positioned at some distance below the lip of the cap 302. The cap diaphragm 208 may selectively be positioned at the top of the container cap 100 (near the lip of the cap 302), extended below the main body 102 of the container cap, or placed anywhere along the inner vertical surface of the main body 102 of the container cap. A region of strain relief area 304 or stress concentration is created at the interface between the cap diaphragm 208 and the main body 102 of the container cap by reducing the cross sectional area of the cap diaphragm 208 at the interface between the cap diaphragm 208 and the main body 102 of the container cap 100. The cross sectional area of the diaphragm 208 may selectively be reduced by removing material from the bottom of the cap diaphragm 208, or any combination of the bottom or top of the cap diaphragm 208. If the cap diaphragm 208 is made sufficiently thin, reducing the cross sectional area in this region may not be necessary.

The strain relief area 304 or stress concentration area is shown in FIG. 3 as being circular to facilitate ease of operation and clearance between the cap diaphragm 208 and the main body 102 of the cap. In an alternate embodiment, the strain relief area 304 may selectively be elliptical, conical, triangular or any number of other different geometries. In the present embodiment, a small section of the strain relief area 304 of the cap diaphragm 208 is left the same thickness as the rest of the cap diaphragm 208 to prevent the cap diaphragm 208 from being completely sheared from the main body 102 of the container cap 100.

The engagement ring 202 is discontinuous with a discontinuity space 204. This discontinuity space 204 provides clearance for an offset puncture tool such that the container cap 100 can be engaged with the bottle or other container without puncturing the cap diaphragm 208. The engagement ring 202 also contains several steps or spacing as shown in FIG. 3 to increase the opening between the cap diaphragm and the main body 102 of the cap when the offset tool is engaged. These increases are shown discretely but the increase could be continuous about the length of the engagement ring. In an alternate embodiment, an increased opening is not necessary and the increased step size is not needed. In the present embodiment, the engagement ring 202 as seen in FIG. 3, is shown to be circular, but it could be elliptical, conical, triangular or any number of different geometries to facilitate ease of operation of clearance between the diaphragm and main body of the cap. The engagement ring 202 is shown as being perpendicular to the inner surface of the main body 102, but in an alternate embodiment, the engagement ring 202 may be at an angle other than ninety degrees with the main body 102.

Figure 4:
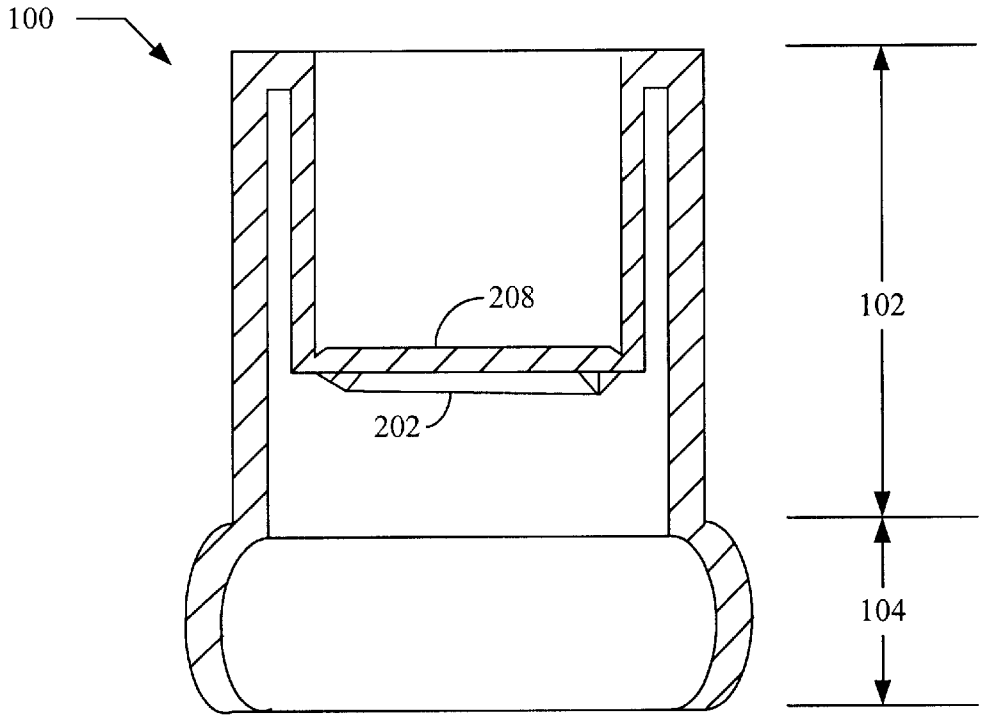
FIG. 4 is a cross section view of the container cap assembly of FIG. 1 along "B" in FIG. 2.

Turning to FIG. 4, a cross section view of the container cap 100 of FIG. 1 along "B" in FIG. 2 is shown. The container cap 100 has the main body 102 with the annular securing ring 104. The engagement ring 202 is secured or formed within the inner surface of the main body 102 and below the cap diaphragm 208 that seals the container. The engagement ring 202 is shown in FIG. 4 as being tapered around the ring that enables the force applied to the diaphragm to be increased as the cap is open. In an alternate embodiment, the engagement ring 202 may have the same height along the majority of the ring.

Figure 5:
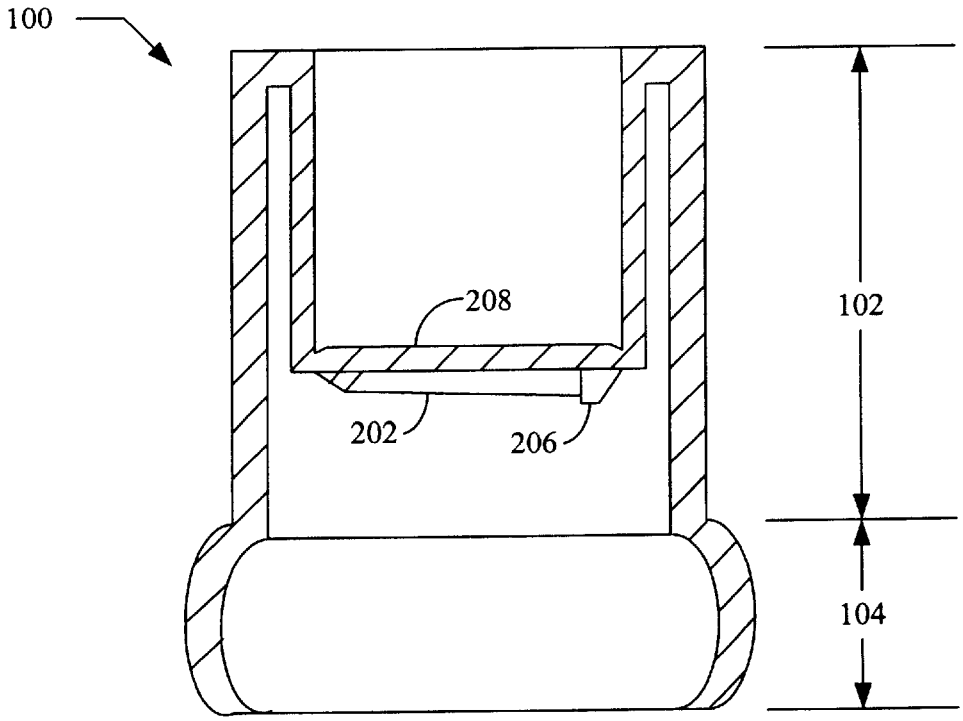
FIG. 5 is a cross section view of the container cap of FIG. 1 along C in FIG. 2.

In FIG. 5, a cross section view of the container cap of FIG. 1 along C in FIG. 2 is shown. The container cap 100 has the main body 102 with the annular securing ring 104. The engagement ring 202 is secured or formed within the inner surface of the main body 102 and below a cap diaphragm 208 that seals the area inside main body 102. The engagement ring 202 forms a discontinuity space 204 and has a rotational stop 206.

Figure 6:
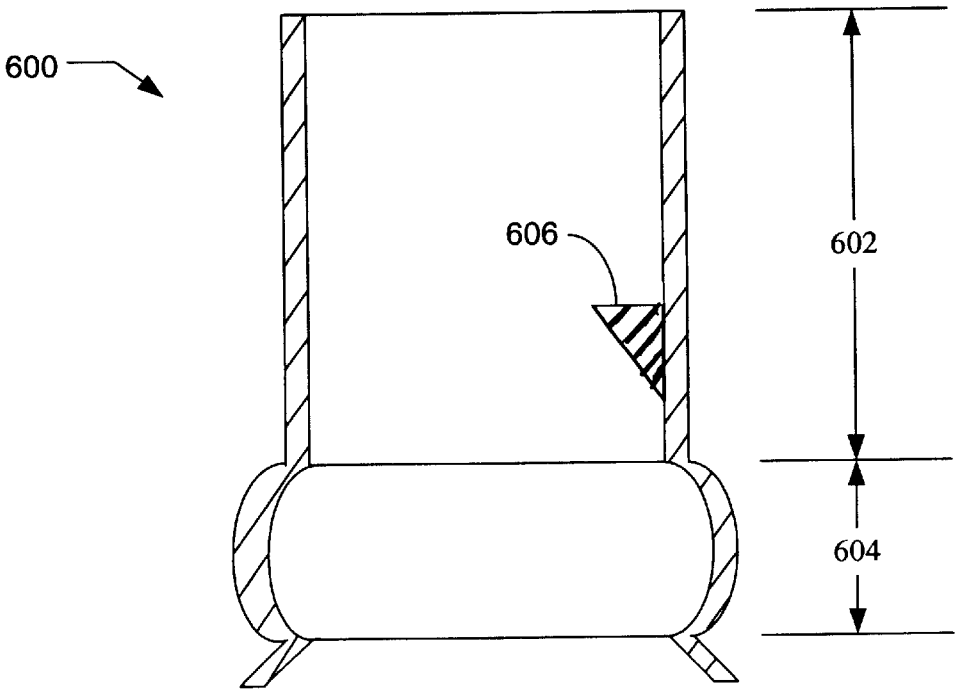
FIG. 6 is a side view cross section of the neck of the container in accordance with an embodiment of the invention.

Turning to FIG. 6, a side view of the container neck 600 is shown. The container neck has a main container neck 602 and a container annular securing ring 604. The inner surface of the main container neck 602 has an offset puncture tool 606.

The container may selectively be made of plastic or any other material suitable for containing a liquid or solid material (i.e. granular). The offset puncture tool 606 is preferable molded to the inner surface of the main container neck 602. In alternate embodiments, the offset puncture tool 606 can be affixed to the inner surface of the main container neck 602 by adhesives or other types of bonding. The offset puncture tool 606 is shown to be triangular but in an alternate embodiment may selectively be square, rectangular or any of a number of geometries suitable for engaging the engagement ring.

Figure 7:
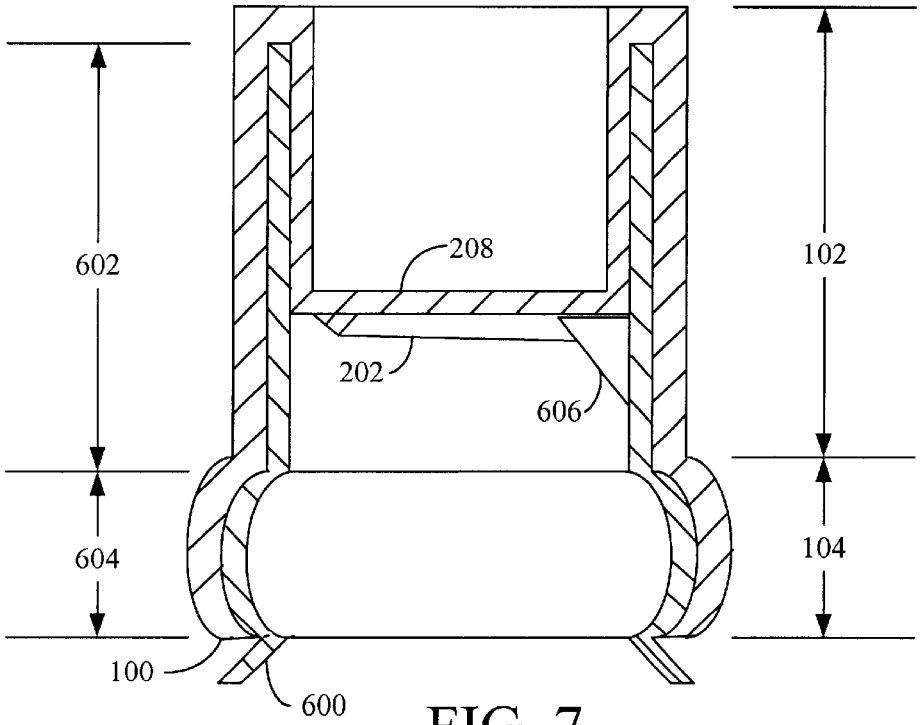
FIG. 7 is a cross section view of the container cap of FIG. 1 as it is attached to the container neck of FIG. 6.

In FIG. 7, a cross section view of the container cap 100, FIG. 1, as it is attached to the container neck 600, FIG. 6, is shown. The container annular securing ring 604 is positioned at the base of the container neck 600. The offset tool lies in the discontinuity space 204, FIG. 3, of the engagement ring 202, FIG. 7. These features could be positioned in any of a number of combinations. For example the annular securing ring 604 could be positioned above the offset tool 606 or anywhere along the inside or outside surface of the neck of the container. The profile of the securing ring 604 may be semicircular, triangular, square, or any of a number of different geometries. In addition, a plurality of securing rings of different sizes could be used to accomplish the same means.

The operation of the container cap 100 is to press the press fitting over the container neck 600 such that in the unopened position the offset puncture tool 606 is positioned in the recessed portion of the engagement ring 202. In alternate embodiments, the container cap 100 may selectively screw on, shirk fit, be affixed by glue, or melting the container to the cap. The container can then be opened from the inverted position by rotating the container cap 100 circumferentially with respect to the container neck 600. This rotational motion causes the offset puncture tool 606 to engage the engagement ring 202 which subsequently generates a shear stress that is concentrated outside of the engagement ring 202 in the area where the cap diaphragm 208 is attached to the main body 102 of the container cap 100. Continued circumferential rotation of the container cap 100 with respect to the container generates a fracture in the cap diaphragm 208 that continues to propagate as the cap is rotated. The aperture between the main body 102 and the cap diaphragm 208 is increased as the offset puncture tool 606 is rotated across the increasingly thick engagement ring 202. The rotational motion is finally terminated when the vertical surface of the offset puncture tool 606 engages the rotational stop 206, FIG. 3.

The offset puncture tool 606, FIG. 7, and engagement ring 202 may selectively be incorporated onto the outside of an alternate embodiment to further prevent inadvertent opening or tampering. Eccentric rings incorporated into the container cap 100 and in conjunction with an external fracture ring may also be used as a tamper resistant seal. A ring and pull-tab or other techniques for tamper resistant seals are known to by a person versed in the art and may be utilized in alternate embodiments.

Figure 8:
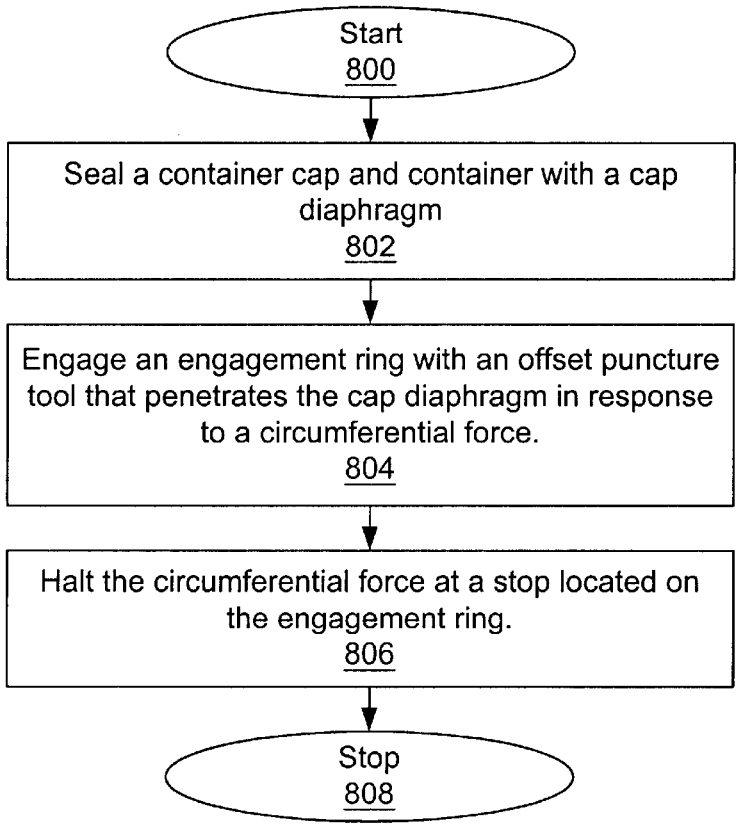
FIG. 8 is a process flow chart for the operation of an invertible container cap funnel in accordance with an embodiment of the invention.

Turning to FIG. 8, a process flow chart for the operation of an invertible container cap funnel is shown. The process starts at step 800 by having a container cap on the container. The container is sealed in step 802 by a cap diaphragm 208, FIG. 3, located in the container cap 100. In step 804, FIG. 8, the engagement ring 202, FIG. 3, is engaged by the offset puncture tool 606, FIG. 6, that penetrates the cap diaphragm 202 in response to a circumferential force. The circumferential force is halted (i.e. movement of the container cap 100) by a stop 206, FIG. 3, located on the engagement ring 202 in step 806, FIG. 8. The process is complete in step 808 and the container is open while upright or inverted.

Figure 9:
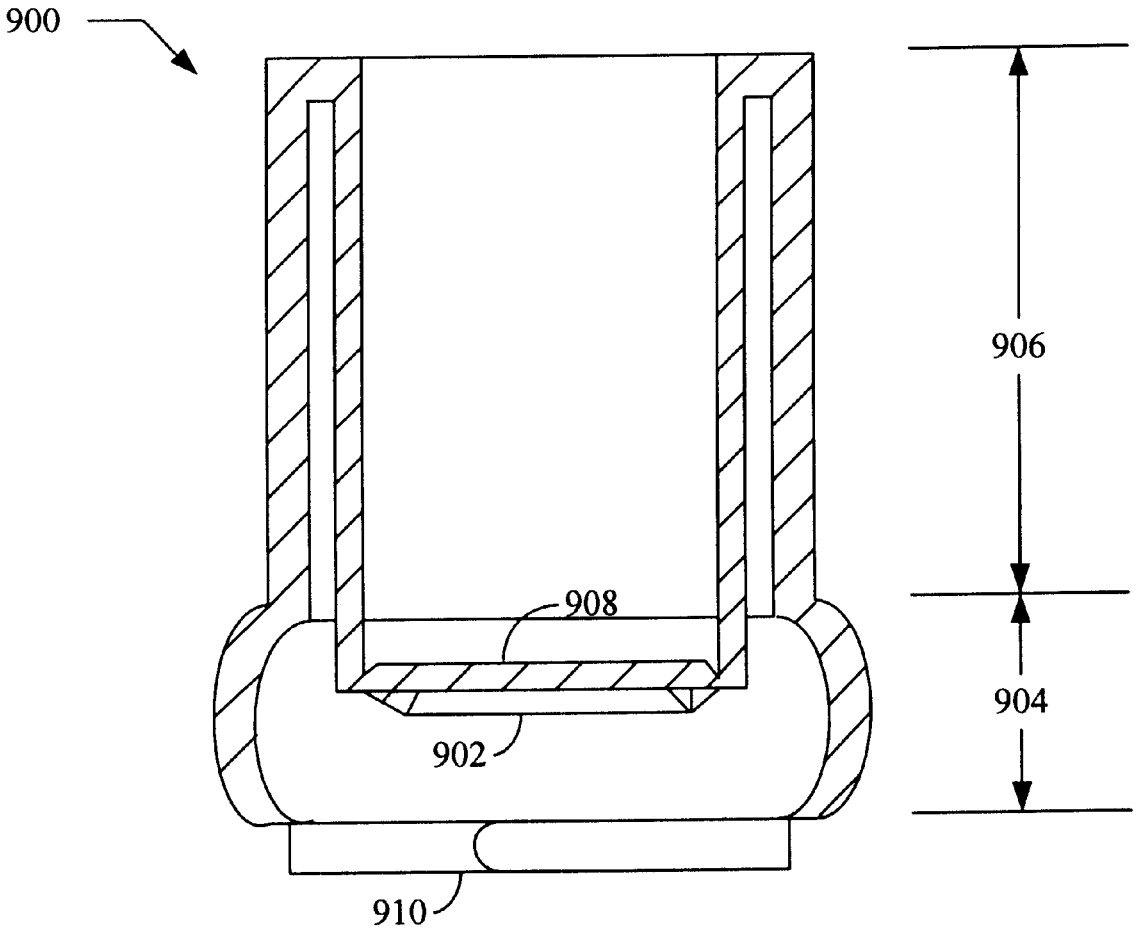
FIG. 9 is a cross sectional view of an alternate container cap embodiment.

In FIG. 9, a cross sectional view of an alternate container cap embodiment is show. Container cap 900 has a main body 906 with an annular securing ring 904. An engagement ring 902 is located within the annular securing ring 904 below a cap diaphragm 908. The annular securing ring 906 is shown as having a constant height in the present embodiment of the container cap 900. Further, a tamper resistant pull ring 910 is attached to the container cap 900 to prevent inadvertent opening or tampering with the sealed container.

While the invention has been particularly shown and described with reference to a particular embodiment, it will be understood by those skilled in the art that various changes in form and details may be made therein without departing from the spirit and scope of the invention and it is intended that all such changes come within the scope of the following claims.

What is claimed is:

1. A container cap apparatus for a container, comprising:

a body having a cap diaphragm and a cap neck with a base; and an engagement ring located on the cap diaphragm associated with an offset puncture tool in the container; and the engagement ring contacting the offset puncture tool that results in the detachment of at least a part of the cap diaphragm in response to a circumferential force applied to the engagement ring for opening the container cap apparatus.

2. The container cap apparatus of claim 1, further comprising an at least one annular securing ring at the base of the cap neck that engages a container neck.

3. The container cap apparatus of claim 2, wherein the cap diaphragm is located in the at least one annular securing ring.

4. The container cap apparatus of claim 1, wherein the engagement ring is less than 360 degrees forming a discontinuous space in the engagement ring.

5. The container cap apparatus of claim 1, wherein the engagement ring has a constant height.

6. The container cap apparatus of claim 1, further comprising a rotational stop located on the engagement ring.

7. The container cap apparatus of claim 1, wherein a strain relief region is located at an interface of the cap diaphragm and the container cap.

8. The container cap apparatus of claim 7, wherein the cap diaphragm tapers at an interface with the container cap.

9. The container cap apparatus of claim 7, wherein the strain relief region is located at only a portion of the interface of the cap diaphragm and container cap to prevent the cap diaphragm from being completely detached from the container cap.

10. The container cap apparatus of claim 1, further comprising a tamper resistant ring that identifies if the container cap has been opened.

11. A method for inverting a container with a container cap having a base, comprising the steps of:

sealing the container cap with a cap diaphragm; and engaging an engagement ring located on the cap diaphragm with an offset puncture tool in the container that detaches at least a part the cap diaphragm in response to a circumferential force.

12. The method of claim 11, further comprising the step of securing an at least one annular securing ring at the base of the container cap that engages a container neck.

13. The method of claim 11, wherein the cap diaphragm is located in the at least one annular securing ring.

14. The method of claim 11, wherein the engagement ring is less than 360 degrees forming a discontinuous space in the engagement ring.

15. The method of claim 11, further comprising the step of halting the circumferential force at a stop located on the engagement ring.

16. The method of claim 11, further comprising the step of securing the container cap with a tamper resistant ring that identifies if the container cap has been opened.

17. An apparatus for inverting a container with a container cap having a base, comprising:

a means for sealing the container cap with a cap diaphragm; and a means for engaging an engagement ring located on the cap diaphragm with an offset puncture tool in the container that detaches at least a part the cap diaphragm in response to a circumferential force.

18. The apparatus of claim 17, further comprising a means for securing an at least one annular securing ring at the base of the container cap that engages a container neck.

19. The apparatus of claim 18, wherein the cap diaphragm is located in the at least one annular securing ring.

20. The apparatus of claim 17, wherein the engagement ring is less than 360 degrees forming a discontinuous space in the engagement ring.

21. The apparatus of claim 17, further comprising a means for halting the circumferential force.

22. The apparatus of claim 17, further comprising a means for securing the container cap with a tamper resistant ring that identifies if the container cap has been opened.

23. The apparatus of claim 17, further comprising a means located on the engagement ring that prevents the cap diaphragm from being completely detached from the container cap.

* * * * *